US008408139B2

(12) United States Patent
Baumann et al.

(10) Patent No.: US 8,408,139 B2
(45) Date of Patent: Apr. 2, 2013

(54) PROJECTILE

(75) Inventors: Christian Baumann, Martinsrieth (DE); Thomas Heitmann, Unterlüss (DE)

(73) Assignee: Rheinmetail Waffe Munition GmbH, Unterluss (DE)

( * ) Notice: Subject to any disclaimer, the term of this patent is extended or adjusted under 35 U.S.C. 154(b) by 10 days.

(21) Appl. No.: 12/786,124

(22) Filed: May 24, 2010

(65) Prior Publication Data

US 2010/0294160 A1 Nov. 25, 2010

Related U.S. Application Data

(63) Continuation-in-part of application No. PCT/EP2008/009239, filed on Nov. 3, 2008.

(30) Foreign Application Priority Data

Nov. 23, 2007 (DE) ..... 10 2007 056 786

(51) Int. Cl.
*F42B 12/22* (2006.01)

(52) U.S. Cl. ..... 102/491; 102/495

(58) Field of Classification Search ..... 102/478, 102/479, 489, 202.6, 265, 270, 493, 494, 102/495, 491, 492
See application file for complete search history.

(56) References Cited

U.S. PATENT DOCUMENTS 1,325,706 A 12/1919 Todisco
3,808,972 A * 5/1974 Cammack et al. ..... 102/394
3,901,158 A * 8/1975 Ferb ..... 102/512
3,906,860 A * 9/1975 Johns ..... 102/476
4,284,007 A 8/1981 Arnell et al.
4,305,333 A * 12/1981 Altenau et al. ..... 102/306
4,312,274 A * 1/1982 Zernow ..... 102/493
4,494,459 A * 1/1985 Ziemba ..... 102/235
4,655,139 A 4/1987 Wilhelm
4,712,482 A 12/1987 Bock et al.
4,807,533 A 2/1989 von Entress-Fursteneck (Continued)

FOREIGN PATENT DOCUMENTS

DE 10018285 A1 * 10/2001
DE 100 25 055 A1 12/2001

(Continued)

OTHER PUBLICATIONS

International Search Report issued in corresponding PCT/EP2008/009239, mailed Mar. 19, 2009, completed Mar. 27, 2009.

(Continued)

*Primary Examiner* — Benjamin P Lee
(74) *Attorney, Agent, or Firm* — Griffin & Szipl, P.C.

(57) ABSTRACT

A projectile (1) is optionally used as a fragmentation projectile or as a projectile that utilizes a pressure wave effect created when the explosive charge (3) explodes. The projectile (1) contains an ejection charge (12), and an explosive charge (3) arranged in a jacket (4) that can be moved axially with respect to a fragmentation casing (5). The ejection charge (12) allows the explosive charge (3) and surrounding jacket (4) to be pushed at least so far out of the projectile casing (2) that, in the event of explosion, the explosive charge does not act on the fragmentation casing (5). In order to ensure that the jacket (4) of the explosive charge (3) does not develop any fragmentation effect, or develops only a small fragmentation effect, when the explosive charge (3) is ignited, a molded part composed of plastic or a light alloy is used as the jacket (4).

16 Claims, 2 Drawing Sheets

U.S. PATENT DOCUMENTS

| | | | | |
|---|---|---|---|---|
| 4,949,639 | A | 8/1990 | Burns | |
| 5,210,372 | A | 5/1993 | Tripptap et al. | |
| 5,235,916 | A * | 8/1993 | Winger | 102/475 |
| 5,251,530 | A * | 10/1993 | Kaeser | 86/20.14 |
| 5,313,890 | A * | 5/1994 | Cuadros | 102/496 |
| 5,542,354 | A | 8/1996 | Sigler | |
| 6,474,240 | B1 | 11/2002 | Chemiere et al. | |
| 6,666,146 | B2 * | 12/2003 | Wardecki et al. | 102/489 |
| 6,857,372 | B2 * | 2/2005 | Renaud-Bezot et al. | 102/493 |
| 6,966,265 | B2 * | 11/2005 | Ronn et al. | 102/514 |
| 7,168,368 | B1 | 1/2007 | Warner et al. | |
| 7,418,905 | B2 * | 9/2008 | Bootes et al. | 102/476 |
| 8,006,623 | B2 * | 8/2011 | Dupont et al. | 102/494 |
| 2002/0014177 | A1 * | 2/2002 | Renaud-Bezot et al. | 102/493 |
| 2002/0166475 | A1 * | 11/2002 | Brooks et al. | 102/489 |
| 2010/0282115 | A1 | 11/2010 | Sheridan et al. | |
| 2011/0023743 | A1 * | 2/2011 | Heitmann | 102/476 |

FOREIGN PATENT DOCUMENTS

| | | | |
|---|---|---|---|
| DE | 102 27 002 | A1 | 1/2004 |
| WO | 01/79780 | A1 | 10/2001 |

OTHER PUBLICATIONS

International Search Report issued in co-pending application PCT/EP2008/009238, mailed Mar. 19, 2009, completed Mar. 25, 2009.

Office Action issued in co-pending related U.S. Appl. No. 12/785,330 on Mar. 28, 2012.

"kraftschlüssig": Dr. -Ing. Richard Ernst, Wörterbuch Der Industriellen Technik 684 (Udo Amm ed., 6th ed. 2004).

"formschlüssigen": Dr. -Ing. Richard Ernst, Wörterbuch Der Industriellen Technik 441 (Udo Amm ed., 6th ed. 2004).

* cited by examiner

PROJECTILE

This is a Continuation-in-Part Application in the United States of International Patent Application No. PCT/EP2008/009239 filed Nov. 3, 2008, which claims priority on German Patent Application No. DE 10 2007 056 786.5, filed Nov. 23, 2007. The entire disclosures of the above patent applications are hereby incorporated by reference.

FIELD OF THE INVENTION

The invention relates to a projectile having a projectile casing in which an explosive charge, enclosed by a fragmentation casing, is arranged wherein the fragmentation casing is connected, for example, securely to the projectile casing and, for igniting the explosive charge, the projectile includes a (first) ignition device adjacent to the explosive charge at the rear, wherein the ignition time of this ignition device can preferably be adjusted.

BACKGROUND OF THE INVENTION

Fragmentation projectiles are customarily constructed in such a way that they enable a targeted strong fragmentation effect in enclosed spaces or in open country. It is, therefore, not possible in accordance with known fragmentation projectiles to use them effectively when the respective combat situation requires that no fragments affect the relevant target, but only the pressure waves developing during the explosion are to be utilized. Such a situation can occur, for example, when a terrorist group is to be combated with a tank projectile embodied as a fragmentation projectile and the tank commander determines immediately before firing the projectile that there is a kindergarten in the vicinity of the terrorist group so that the fragments of the projectile would also endanger a large number of innocent parties.

The object of the present invention is to provide a projectile that optionally acts as a fragmentation projectile, or as a projectile designed with the formation of pressure waves in mind as its main effect on a target.

SUMMARY OF THE INVENTION

This object is achieved, according to a first embodiment of the invention, by a projectile (1) having: a projectile casing (2) in which an explosive charge (3) enclosed by a fragmentation casing (5) is arranged; and an ejection charge (12) as well as an explosive charge (3) that can be displaced axially with respect to a fragmentation casing (5) and is arranged in a jacket (4), as well as an ignition device (6), characterized in that the explosive charge (3) enclosed by the jacket (4) is pushed out of the projectile casing (2) at least so far that during an explosion, it no longer acts on the fragmentation casing (5). Other, particularly advantageous embodiments of the invention are disclosed by the following additional advantageous embodiments.

For example, in accordance with a second embodiment of the present invention, the first embodiment is modified so that the fragmentation casing (5) is securely connected to the projectile casing (2). In accordance with a third embodiment of the present invention, the first embodiment or the second embodiment is further modified so that the explosive charge (3) is supported so that it can be displaced in the projectile casing (2) in the axial direction towards the rear (11) of the projectile (1). In accordance with a third embodiment of the present invention, the first embodiment, the second embodiment and the third embodiment are further modified so that the ejection charge (12) is embodied and arranged in the projectile casing (2) in such a way that after ignition of the ejection charge (12), the developing propellant gases effect a displacement of the explosive charge at the rear and out of the fragmentation casing (5).

In accordance with a fifth embodiment of the present invention, the first embodiment, the second embodiment, the third embodiment and the fourth embodiment are further modified so that the ignition device (6) can be adapted in such a way that the explosive charge (3) is optionally ignited without previous activation of the ejection charge (12), or only after activation of the ejection charge (12) and the complete pushing-out of the explosive charge (3) from the fragmentation casing (5). In accordance with a sixth embodiment of the present invention, the first embodiment, the second embodiment, the third embodiment, the fourth embodiment, and the fifth embodiment, are further modified so that the explosive charge (3) is enclosed by a molded part (4) made of plastic or of a light alloy, wherein the molded part is connected to the ignition device (6) on its side facing the ignition device (6) via an annular flange part (8).

In accordance with a seventh embodiment of the present invention, the first embodiment, the second embodiment, the third embodiment, the fourth embodiment, the fifth embodiment, and the sixth embodiment, are further modified so that, for igniting the explosive charge (3), the ignition time of the ignition device (6) adjacent at the rear to the explosive charge (3) can be adjusted. In accordance with an eighth embodiment of the present invention, the first embodiment, the second embodiment, the third embodiment, the fourth embodiment, the fifth embodiment, the sixth embodiment, and the seventh embodiment, are further modified so that the molded part (4) is composed of a glass- or carbon-fiber-reinforced plastic. In accordance with a ninth embodiment of the present invention, the eighth embodiment is further modified so that the molded part (4) is provided with stiffening ribs (15) extending respectively in the direction of the longitudinal axis (100) of the molded part (4) and arranged uniformly distributed over the circumference.

In accordance with a tenth embodiment of the present invention, the first embodiment, the second embodiment, the third embodiment, the fourth embodiment, the fifth embodiment, the sixth embodiment, the seventh embodiment, the eighth embodiment, and the ninth embodiment are further modified so that the annular flange part (8) is a metal ring whose inner wall (9) has at least one undercut (10) on its side facing the ignition device (6), wherein the undercut is enclosed by the molded part (4). In accordance with an eleventh embodiment of the present invention, the first embodiment, the second embodiment, the third embodiment, the fourth embodiment, the fifth embodiment, the sixth embodiment, the seventh embodiment, the eighth embodiment, the ninth embodiment, and the tenth embodiment, are further modified so that the molded part (4) has a groove-shaped recess (18) on its circumference, in which an O-ring is arranged.

In accordance with a twelfth embodiment of the present invention, the first embodiment, the second embodiment, the third embodiment, the fourth embodiment, the fifth embodiment, the sixth embodiment, the seventh embodiment, the eighth embodiment, the ninth embodiment, the tenth embodiment, and the eleventh embodiment, are further modified so that the ejection charge (12) is arranged in an annular cavity (13) surrounding the fragmentation casing (5) on the outside, and that the unit composed of the molded part (4) with explosive charge (3) and the ignition device (6) has a radially protruding annular surface (14), on which the developing propellant gases act after ignition of the ejection charge (12). In accordance with a thirteenth embodiment of the present invention, the twelfth embodiment is further modified so that the radially protruding annular surface (14) is the front side of the ignition device (6) facing the explosive charge (3). In accordance with a fourteenth embodiment of the present invention, the first embodiment, the second embodiment, the third embodiment, the fourth embodiment, the fifth embodiment, the sixth embodiment, the seventh embodiment, the eighth embodiment, the ninth embodiment, the tenth embodiment, the eleventh embodiment, and the twelfth embodiment, are further modified so that the projectile (1) is a fin-stabilized tank projectile having a caliber ≧100 mm.

In a parallel patent application of the applicant, a projectile has already been suggested that can optionally be used as either a fragmentation projectile, or as a projectile in which only the effect of the pressure waves developing during explosion of the explosive charge of the projectile is utilized as its main effect. To this end, an ejection charge, as well as an explosive charge that can be displaced axially with respect to the fragmentation casing of the projectile, are arranged in the projectile, wherein the explosive charge can be pushed by means of the ejection charge at least so far out of the projectile casing that, during explosion, the explosive charge no longer acts on the fragmentation casing connected securely to the projectile casing.

If the ejection charge is not activated in a projectile of this type, then the projectile acts as a pure fragmentation projectile because the explosive charge—as with known fragmentation projectiles—is situated inside the fragmentation casing and causes the fragmentation casing to rip apart when it explodes. If, on the other hand, the ejection charge is activated before the ignition of the explosive charge, then the explosive charge is first pushed at least partially out of the projectile casing due to the ejection charge, and thus out of the fragmentation casing, which is left intact as part of a residual projectile, so that the subsequently activated explosive charge causes no ripping apart of the fragmentation casing remaining in the residual projectile, and, in this case, only the pressure waves of the explosive charge take effect in the target zone.

Because the explosive charge must have a certain minimum stiffness due to the acceleration forces occurring during the firing of the projectile, it is provided, for the above-referenced projectile, to arrange the explosive charge inside a metal jacket (for example, a copper jacket). However, a metal jacket of this type generates undesirable fragments to when the explosive charge is ignited, even when the explosive charge has already been pushed out of the fragmentation casing.

Starting from the previously described, but not yet published projectile, the present invention is based essentially on the concept of encasing the explosive charge with a jacket that develops no fragmentation action, or only a slight fragmentation action, during ignition of the explosive charge. As a jacket for the explosive charge, in accordance with the present invention, a molded part made of plastic (preferably a glass- or carbon-fiber-reinforced plastic) or of a light alloy (for example, made of aluminum die casting) is used. In order to ensure a sufficiently high stiffness of the explosive charge during the firing of the projectile, according to the invention, it has proved to be advantageous if the molded part is provided with several stiffening ribs respectively extending in the direction of the longitudinal axis of the projectile and arranged uniformly distributed over the circumference of the molded part.

In order to bind the molded part, which contains the explosive charge, to the ignition device optimally, it has proved to be expedient to connect the molded part, with the explosive charge situated therein, to the ignition device with the aid of an annular flange part. The annular flange part can be a metal ring whose inner wall, on the side facing the ignition device, has at least one undercut, which is enclosed by the molded part in. In particular, during production of the respective molded part by injection molding, the metal ring can be injection-molded from the plastic or light alloy at the same time during the production of the molded part. Of course, if the metal ring is made of injection molded plastic instead of metal, then it is a plastic ring.

In addition to the axial stiffening of the molded part by means of longitudinal ribs, an O-ring can also be arranged on the circumference in a groove-shaped recess, wherein the O-ring, in the case of production of the molded part by means of an injection procedure, can be injected directly onto the molded part at the same time the molded part is produced by injection molding.

The projectile of the present invention can, for example, be a fin-stabilized tank projectile having a caliber ≧100 mm (e.g., having a caliber of 120 mm).

BRIEF DESCRIPTION OF THE DRAWINGS

Further details and advantages of the invention are disclosed in the following exemplary embodiments explained on the basis of the figures, which show.

DETAILED DESCRIPTION OF THE INVENTION

Figure 1:
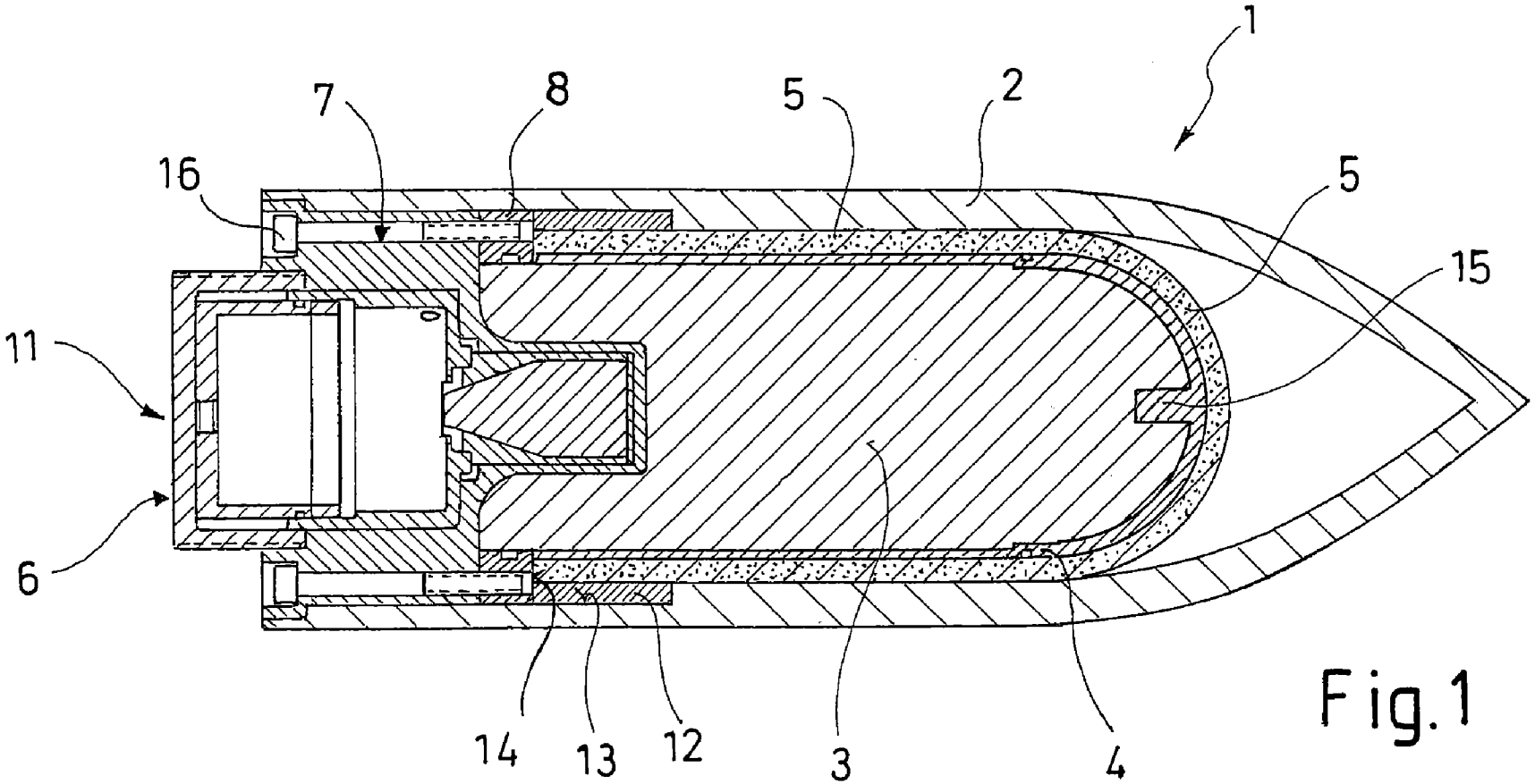
FIG. 1 illustrating a longitudinal section through a projectile according to the invention and having an explosive charge at the rear that can be pushed out of the projectile.

In FIG. 1, 1 designates a large-caliber fin-stabilized projectile (e.g., a fragmentation warhead having a caliber of, e.g., 120 mm) that can be fired from a tank cannon. The fins of the fin-stabilized projectile 1 are not shown for the sake of better visibility.

The projectile 1 has a projectile casing 2, inside of which an explosive charge 3 is arranged. The explosive charge 3 is enclosed by a molded part 4 made of a glass- or carbon-fiber-reinforced plastic that is situated inside a fragmentation casing 5 connected to the projectile casing 2. The fragmentation casing 5 is securely connected to the projectile casing 2, for example, via several steel grooved pins (not shown) arranged uniformly distributed over the circumference of the fragmentation casing 5.

Figure 2:
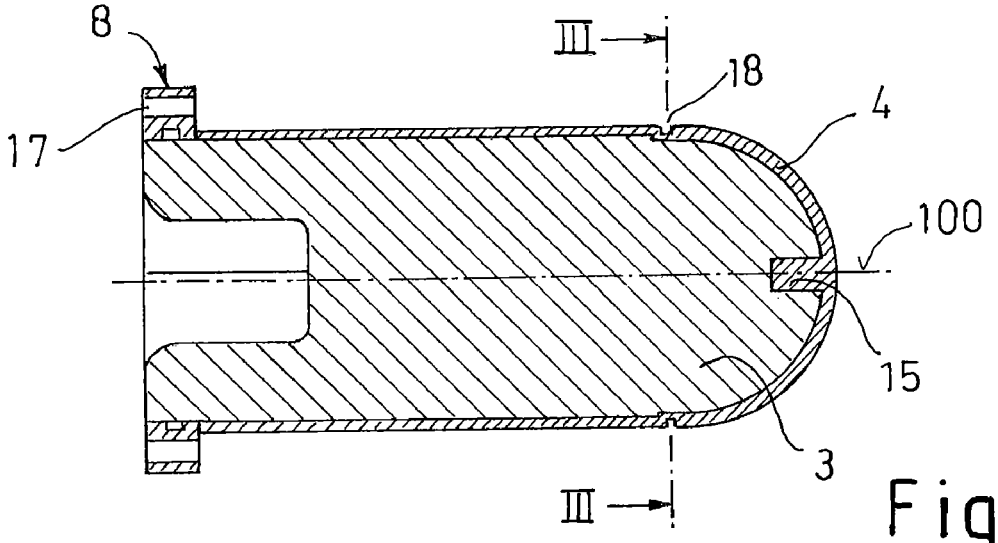
FIG. 2 illustrates a longitudinal section through the explosive charge shown in FIG. 1, which is provided with a molded part enclosing the explosive charge.

Moreover, for igniting the explosive charge 3 in the projectile casing 2, an ignition device or igniter 6, the ignition time of which can be adjusted, is arranged at the rear of the projectile 1 and adjacent to the explosive charge 3 (for the sake of better visibility in FIG. 1, only the receptacle device for the igniter, otherwise not shown, is reproduced). The housing 7 of the ignition device 6, and the molded part 4 enclosing the explosive charge 3, are connected to one another and form a unit. For this purpose, a flange part 8 is provided, and is embodied as a metal ring that is fixed to the molded part 4, wherein the flange part 8 has threaded holes 17, as shown in FIG. 2, that are arranged and distributed over the circumference of the explosive charge 3. With the aid of screws 16, whose shanks are guided through the housing 7 of the ignition device 6 and are screwed at the front into the threaded holes 17, the ignition device 6 and the molded part 4 containing the explosive charge 3 are connected to one another.

Figure 4:
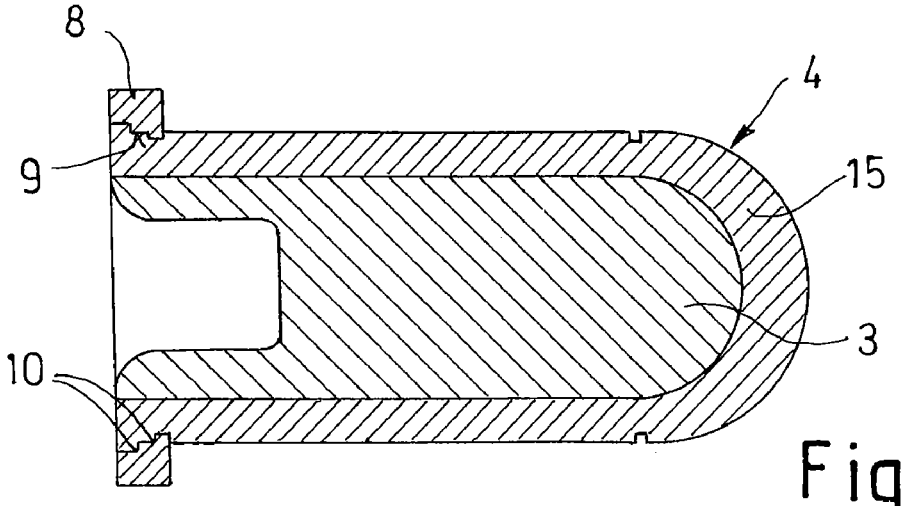
FIG. 4 illustrates a longitudinal cross-section of the explosive charge along the cut line shown in FIG. 3 and designated by IV-IV.

For forming a form-fit connection of the molded part 4 to the flange part 8, the inner wall 9 of the flange part 8 is provided with undercuts 10 on its side facing the ignition device 6 as shown in FIG. 4, wherein these undercuts 10 (for example, by means of injection molding) are enclosed by the fiber-reinforced plastic material of the molded part 4. Thus, the positive connection is formed between the molded part 4 and the flange part 8 by, for example, injection molding so that the material of the molded part 4 forms the positive connection with the undercuts 10 of inner wall 9 of the flange part 8.

The unit, composed of the molded part 4 together with explosive charge 3 and the ignition device 6, is fixed inside the projectile casing 2, for example, in that the ignition device 6 may be adhered to, or pressed into, the projectile casing 2. The unit composed of the molded part 4 and the ignition device 6 (i.e., after overcoming the fixing forces caused by the adhesion or pressing) is supported in the projectile casing 2 so that this unit can be displaced as a whole in the axial direction towards the rear 11 of the projectile 1. This displacement is effected by means of an ejection charge 12, which is arranged in an annular cavity 13 surrounding the fragmentation casing 5 on the outside thereof. The cavity 13 is limited at the rear end by a radially protruding annular surface 14 of the housing 7 of the ignition device 6.

Figure 3:
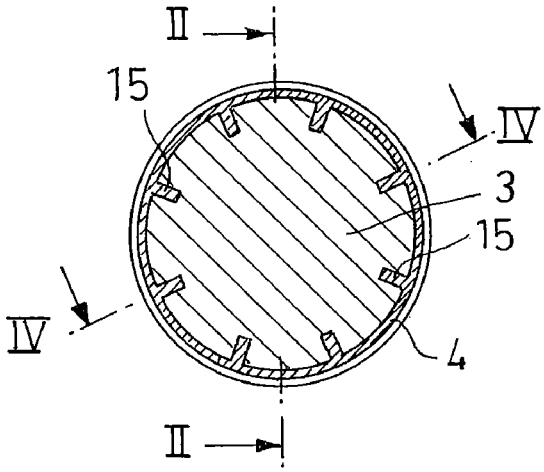
FIG. 3 illustrates a cross-section of the explosive charge along the cut line shown in FIG. 2 as designated by III-III.

To increase the stiffness of the molded part 4, and thus of the explosive charge 3 as well, the molded part 4 is provided with eight stiffening ribs 15 as shown in FIGS. 1 and 3, which are arranged uniformly distributed over the circumference of the molded part 4 and extending respectively in the direction of the longitudinal axis 100 (FIG. 2) of the molded part 4 enclosing the explosive charge 3. As can be seen from FIGS. 2 and 4, in its front part on the outside, the molded part 4 has a surrounding groove-shaped recess 18 for an O-ring, not shown.

Operation of the Projective of the Invention to Produce a Fragmentation Effect

If the projectile 1, according to the present invention, is to presently act in a specified target zone as a fragmentation projectile, then the projectile 1 is fired in the direction of the target zone without transmitting additional information about ignition of the ejection charge 12 to the ignition device 6 before the projectile 1 is fired. Therefore, as soon as a sensor arranged on the projectile 1 detects the target zone, the ignition device 6 is activated and subsequently the explosive charge 3 is activated due to activation of the ignition device 6, so that the fragmentation casing 5 rips open and fragments are hurled into the target zone radially at high speed. In other words, in this first mode of operation of the projectile 1, the projectile 1 is fired at the target without first transmitting additional information regarding ignition of the ejection charge 12; therefore, the ejection charge 12 is not ignited and the explosive charge 3 will explode inside the fragmentation casing 5, thereby ripping the fragmentation casing 5 open and producing high speed fragments.

Operation of the Projective of the Invention to Generate a Pressure Wave Effect

However, if the target zone is to be damaged as little as possible by fragments, and only the pressure wave generated by the activation of the explosive charge 3 is to take effect against the target zone, an additional piece of information is entered into the ignition device 6 by the tank commander prior to firing, so that the ejection charge 12 is activated a short time before the actual ignition of the explosive charge 3. Through propellant gases developing from this ignition of the ejection charge 12, the unit composed of the molded part 4, and containing the explosive charge 3 and the ignition device 6, is ejected against the firing direction of the target zone (i.e., towards the rear of the projectile 1) so that the fragmentation casing 5 remains in the residual projectile while the unit (i.e., molded part 4, explosive charge 3, and ignition device 6) is ejected from the rear of the projective 1. The explosive charge 3 is then ignited by means of the first ignition device 6 connected to it, but only after the explosive charge 3 has been ejected from the projectile casing 2 so that the developing pressure waves no longer acts on the fragmentation casing 5. As a result, any plastic fragments generated by ignition of the explosive charge 3 have only a short range, and a relatively low kinetic energy, so that the substantial effect damaging to the target is mainly due to the pressure wave generated by the ignited explosive charge and does not include, as a rule, damage caused because of the short range, low kinetic energy fragments from the molded part 4. As described above, the ignition time of the ignition device 6 can be adjusted.

In other words, in this second mode of operation of projectile 1, the projectile 1 is provided with additional information prior to firing that instructs the ignition device 6 to activate the ejection charge 12 before the explosive charge 3 so that propellant gases developed by the activated ejection charge 12 ejects the unit (i.e., molded part 4, explosive charge 3, and ignition device 6) rearward from the projectile 1 so that when the explosive charge 3 ignites, it is not surrounded by the fragmentation casing 5. Consequently, the fragmentation casing 5 does not rip open and fragments of the fragmentation casing 5 are not produced. While fragments may be generated by the molded part 4, for example, these fragments have a short range and a low kinetic energy. In this case, the ignition device 6 is operating in a second mode of operation so that the projectile 1 behaves substantially as a projectile utilizing primarily pressure waves to effect a target.

Of course, the invention is not limited to the exemplary embodiment described above. Thus, the molded part 4 can, for example, also be made of a light alloy because the light alloy fragments resulting during the activation of the explosive charge 3 likewise have a substantially shorter range and lower kinetic energy than steel- or copper fragments.

REFERENCE LIST

1 Projectile
2 Projectile casing
3 Explosive charge
4 Molded part, jacket
5 Fragmentation casing
6 Ignition device
7 Housing of the Ignition device
8 Flange part
9 Inner wall of the Flange part
10 Undercut of the inner wall of the Flange part
11 Rear of the projectile
12 Ejection charge
13 Cavity
14 Annular surface of the housing of the Ignition device
15 Stiffening rib
16 Screw
17 Threaded hole in Flange part
18 Recess of molded part
100 Longitudinal axis of molded part

The invention claimed is:

1. A projectile comprising:

(a) a projectile casing in which an explosive charge is arranged, wherein the explosive charge is enclosed by a fragmentation casing;

(b) an ejection charge disposed to displace the explosive charge axially with respect to a fragmentation casing when the ejection charge is ignited, wherein the explosive charge is arranged in a jacket, wherein the jacket is a molded part made of plastic or made of a light alloy, wherein the jacket develops no fragmentation action or only a slight fragmentation action during an ignition of the explosive charge, and wherein the molded part is connected to the ignition device via an annular flange part on a side of the molded part facing an ignition device; and (c) the ignition device operably connected to ignite the ejection charge and the explosive charge, wherein the ignition device operates in a first mode and in a second mode, wherein in the first mode of operation, the ignition device ignites only the explosive charge so that the explosive charge explodes in the fragmentation casing thereby ripping apart the fragmentation casing and hurling fragments of the fragmentation casing at high speeds, and in the second mode of operation, the ignition device first ignites the ejection charge, and subsequently the ignition device ignites the explosive charge so that explosion of the ejection charge causes the explosive charge enclosed by the jacket to be pushed out of the projectile casing and the fragmentation casing at least so far that, during explosion of the explosive charge, the explosive charge does not substantially act on the fragmentation casing so that high speed fragments of the fragmentation casing are not hurled by the explosion of the explosive charge.

2. A projectile according to claim 1, wherein the fragmentation casing is securely connected to the projectile casing so that during explosion of the ejection charge, the fragmentation casing remains connected to the projectile casing.

3. A projectile according to claim 2, wherein the explosive charge is supported so that the explosive charge is displaced in the projectile casing in an axial direction towards a rear of the projectile when the ejection charge explodes.

4. A projectile according to claim 1, wherein the explosive charge is supported so that the explosive charge is displaced in the projectile casing in an axial direction towards a rear of the projectile when the ejection charge explodes.

5. A projectile according to claim 1, wherein the ejection charge is embodied and arranged in the projectile casing so that after ignition of the ejection charge, the developing propellant gases effect displacement of the explosive charge at a rear portion of the projectile and out of the fragmentation casing.

6. A projectile according to claim 1, wherein the ignition device is adapted to operate in the first mode so that the explosive charge is ignited without previous activation of the ejection charge, and in the second mode, the explosive charge is ignited only after activation of the ejection charge and after the complete pushing-out of the explosive charge from the fragmentation casing.

7. A projectile according to claim 1, wherein, in order to ignite the explosive charge, the ignition device is disposed adjacent to, and at the rear of, the explosive charge and the ignition time of the ignition device is adjustable.

8. A projectile according to claim 1, wherein the molded part comprises a glass- or carbon-fiber-reinforced plastic.

9. A projectile according to claim 8, wherein the molded part is provided with stiffening ribs extending respectively in a direction of a longitudinal axis of the molded part and the stiffening ribs are arranged so as to be uniformly distributed over a circumference of the molded part.

10. A projectile according to claim 1, wherein the molded part has a groove-shaped recess on a circumference of the molded part, and an O-ring is arranged in the groove-shaped recess.

11. A projectile according to claim 1, wherein the projectile is a fin-stabilized tank projectile having a caliber $\geqq$100 mm.

12. A projectile according to claim 1, further comprising:

(d) an annular flange part that is a ring that has been injection-molded from the plastic or light alloy at the same time as the production of the molded part, wherein an inner wall of the annular flange part has at least one undercut on a side facing the ignition device, wherein the undercut is enclosed by the molded part so as to connect the ignition device, the molded part, and the explosive charge arranged in the molded part, together.

13. A projectile comprising:

(a) a projectile casing in which an explosive charge is arranged, wherein the explosive charge is enclosed by a fragmentation casing;

(b) an ejection charge disposed to displace the explosive charge axially with respect to a fragmentation casing when the ejection charge is ignited, wherein the explosive charge is arranged in a jacket, and the jacket is a molded part made of plastic or made of a light alloy, wherein the molded part is connected to an ignition device via an annular flange part on a side of the molded part facing the ignition device;

(c) the ignition device operably connected to ignite the ejection charge and the explosive charge, wherein the ignition device operates in a first mode and in a second mode, wherein in the first mode of operation, the ignition device ignites only the explosive charge so that the explosive charge explodes in the fragmentation casing thereby ripping apart the fragmentation casing and hurling fragments of the fragmentation casing at high speeds, and in the second mode of operation, the ignition device first ignites the ejection charge, and subsequently the ignition device ignites the explosive charge so that explosion of the ejection charge causes the explosive charge enclosed by the jacket to be pushed out of the projectile casing and the fragmentation casing at least so far that, during explosion of the explosive charge, the explosive charge does not substantially act on the fragmentation casing so that high speed fragments of the fragmentation casing are not hurled by the explosion of the explosive charge; and (d) an annular flange part that is a metal ring whose inner wall has at least one undercut on a side facing the ignition device, wherein the undercut is enclosed by the molded part so as to connect the ignition device, the molded part, and the explosive charge arranged in the molded part, together.

14. A projectile according to claim 13, wherein the ignition device, the molded part, and the explosive charge arranged in the molded part, are connected together as a unit.

15. A projectile comprising:

(a) a projectile casing in which an explosive charge is arranged, wherein the explosive charge is enclosed by a fragmentation casing;

(b) an ejection charge disposed to displace the explosive charge axially with respect to a fragmentation casing when the ejection charge is ignited, wherein the explosive charge is arranged in a jacket, and the jacket is a molded part made of plastic or made of a light alloy, wherein the molded part is connected to the ignition device via an annular flange part on a side of the molded part facing the ignition device, and wherein the ejection charge is arranged in an annular cavity surrounding the fragmentation casing on an outside thereof, and the projectile includes a unit that includes the molded part, provided with the explosive charge, and an ignition device, wherein the ignition device has a radially protruding annular surface on which developing propellant gases act after ignition of the ejection charge; and (c) the ignition device operably connected to ignite the ejection charge and the explosive charge, wherein the ignition device operates in a first mode and in a second mode, wherein in the first mode of operation, the ignition device ignites only the explosive charge so that the explosive charge explodes in the fragmentation casing thereby ripping apart the fragmentation casing and hurling fragments of the fragmentation casing at high speeds, and in the second mode of operation, the ignition device first ignites the ejection charge, and subsequently the ignition device ignites the explosive charge so that explosion of the ejection charge causes the explosive charge enclosed by the jacket to be pushed out of the projectile casing and the fragmentation casing at least so far that, during explosion of the explosive charge, the explosive charge does not substantially act on the fragmentation casing so that high speed fragments of the fragmentation casing are not hurled by the explosion of the explosive charge.

16. A projectile according to claim 15, wherein the radially protruding annular surface is on a front side of the ignition device and faces the explosive charge.

* * * * *